US011369196B2

(12) United States Patent
Hansson

(10) Patent No.: US 11,369,196 B2
(45) Date of Patent: Jun. 28, 2022

(54) FURNITURE ASSEMBLY

(71) Applicant: CONCENTUS PROPERTIES AB, Kalix (SE)

(72) Inventor: Daniel Hansson, Piteå (SE)

(73) Assignee: CONCENTUS PROPERTIES AB, Kalix (SE)

( * ) Notice: Subject to any disclaimer, the term of this patent is extended or adjusted under 35 U.S.C. 154(b) by 0 days.

(21) Appl. No.: 17/054,955

(22) PCT Filed: Jun. 10, 2019

(86) PCT No.: PCT/SE2019/050538
§ 371 (c)(1),
(2) Date: Nov. 12, 2020

(87) PCT Pub. No.: WO2019/245429
PCT Pub. Date: Dec. 26, 2019

(65) Prior Publication Data

US 2021/0244181 A1 Aug. 12, 2021

(30) Foreign Application Priority Data

Jun. 20, 2018 (SE) ..... 1850749-1

(51) Int. Cl.

| | |
|---|---|
| ***A47B 77/02*** | (2006.01) |
| ***A47B 77/06*** | (2006.01) |
| ***A47B 77/08*** | (2006.01) |
| ***D06F 39/00*** | (2020.01) |
| ***D06F 39/12*** | (2006.01) |
| ***D06F 58/20*** | (2006.01) |

(52) U.S. Cl.
CPC ..... *A47B 77/02* (2013.01); *A47B 77/06* (2013.01); *A47B 77/08* (2013.01); *D06F 39/001* (2013.01); *D06F 39/12* (2013.01); *D06F 58/20* (2013.01)

(58) Field of Classification Search
CPC ..... A47B 77/02; A47B 77/06; A47B 77/08; D06F 39/001; D06F 39/12; D06F 58/20
USPC ..... 312/209, 107
See application file for complete search history.

(56) References Cited

U.S. PATENT DOCUMENTS

| | | | | |
|---|---|---|---|---|
| 2,550,539 A * | 4/1951 | Guyon | ..... | A47B 77/16 312/228 |
| 3,746,417 A | 7/1973 | Sasnett | | |
| 4,905,428 A * | 3/1990 | Sykes | ..... | E04B 2/7425 160/135 |
| 8,087,735 B1 | 1/2012 | Rheault et al. | | |

(Continued)

FOREIGN PATENT DOCUMENTS

| | | |
|---|---|---|
| DE | 31 06 310 A1 | 9/1982 |
| DE | 37 31 869 A1 | 4/1988 |

(Continued)

*Primary Examiner* — James O Hansen
(74) *Attorney, Agent, or Firm* — Dilworth & Barrese, LLP

(57) ABSTRACT

A furniture assembly (1; 101) comprising: —an upper module (3; 103); —a lower module (5; 105); and —a wall part (7; 107) which is arranged for being provided between the upper and the lower module when the furniture assembly (1; 101) is mounted in a room in a mounting position with the upper module (3; 103) provided above the lower module (5; 105), wherein said wall part (7; 107) is pre-mounted to either the upper module (3; 103) or the lower module (5; 105).

12 Claims, 5 Drawing Sheets

(56) References Cited

U.S. PATENT DOCUMENTS

| | | | | |
|---|---|---|---|---|
| 2009/0001860 | A1* | 1/2009 | Marashi | A47B 21/00 312/223.3 |
| 2009/0108718 | A1* | 4/2009 | Craig | A47B 77/02 312/109 |
| 2011/0115351 | A1 | 5/2011 | McManic et al. | |

FOREIGN PATENT DOCUMENTS

| | | | |
|---|---|---|---|
| DE | 10 2005 041 017 | A1 | 3/2007 |
| JP | H11-75962 | A | 3/1999 |
| JP | 2002-369724 | A | 12/2002 |
| JP | 2007-54237 | A | 3/2007 |
| WO | 2006/115000 | A1 | 11/2006 |

* cited by examiner

101

FURNITURE ASSEMBLY

TECHNICAL FIELD OF THE INVENTION

The present invention relates to a furniture assembly, an upper or a lower module of a furniture assembly and to a method for delivering and mounting a furniture assembly in a room.

BACKGROUND OF THE INVENTION

When mounting furniture systems in for example kitchens an upper module is often mounted to a wall in the kitchen and a lower module can be provided standing on the floor below the upper module. The upper module typically comprises for example cabinets, shelves and fan and the lower module typically comprises worktop, cabinets, drawers, stove, dishwasher etc. After mounting of the upper and lower modules a wall between the modules is provided with for example tiles, glass, metal or another material which can be easily wiped off.

SUMMARY

An object of the present invention is to provide a furniture assembly which can be delivered and mounted in a room in a convenient way.

A further object of the invention is to provide an improved method for delivering and mounting a furniture assembly in a room.

This is achieved by a furniture assembly, an upper or lower module of a furniture assembly and by a method for delivering and mounting a furniture assembly in a room according to the independent claims.

According to one aspect of the invention a furniture assembly is provided comprising:

an upper module;

a lower module; and a wall part which is arranged for being provided between the upper and the lower module when the furniture assembly is mounted in a room in a mounting position with the upper module provided above the lower module, wherein said wall part is pre-mounted to either the upper module or the lower module.

According to another aspect of the invention an upper or lower module of a furniture assembly is provided, wherein said upper or lower module comprises a pre-mounted wall part projecting from a backside of the upper or lower module, wherein said wall part is arranged for being provided between the upper and the lower module when the furniture assembly is mounted in a room in a mounting position with the upper module provided above the lower module.

According to another aspect of the invention a method for delivering and mounting a furniture assembly according to the invention in a room is provided. Said method comprising the steps:

providing the furniture assembly in a delivery position, wherein a distance between the upper module and the lower module is smaller in the delivery position than in a mounting position and wherein the pre-mounted wall part in the delivery position is projecting overlapping a part of a backside of the one of the upper module or lower module to which it is not pre-mounted;

transferring the furniture assembly in its delivery position to a place in a room where it should be mounted;

providing the furniture assembly in a mounting position by raising the upper module in relation to the lower module such that the wall part is adjoining a backside of the upper module with a backside of the lower module.

Hereby a furniture assembly is provided which can be provided in a compact delivery position. The upper module can be provided leaning on the lower module while the wall part is projecting over a part of a back side of the upper or lower module to which the wall part is not pre-mounted. This is advantageous for example when transporting the furniture assembly to the room where it should be mounted. For example through door openings and in lifts where there is limit space. Furthermore mounting of the furniture assembly is facilitated and speeded up when the wall part is pre-mounted to one of the upper or lower modules.

In one embodiment of the invention said furniture assembly can be provided in a delivery position and in a mounting position, wherein a distance between the upper module and the lower module is smaller in the delivery position than in the mounting position and wherein the pre-mounted wall part in the delivery position is projecting overlapping a part of a backside of the one of the upper or lower module to which it is not pre-mounted.

In one embodiment of the invention the wall part is reaching between a lower side of a backside of the upper module and an upper side of a backside of the lower module when the furniture assembly is in the mounting position.

In one embodiment of the invention the wall part is pre-mounted to either the upper or the lower module and not mounted to the other one of the upper or the lower module such that it can be slid in relation to the one of the upper or lower module to which it is not pre-mounted into a delivery position where the upper and lower modules are provided closer to each other and the wall part is covering a part of a backside of the one of the upper or lower module to which it is not pre-mounted and into a mounting position in which the wall part is adjoining a backside of the upper module with a backside of the lower module.

In one embodiment of the invention the wall part has a wipeable surface and is provided onto a projecting part of a board which is mounted to a backside of the upper module or the lower module, said board being mounted such that the projecting part of the board projects from the backside of the upper or lower module, wherein the projecting part of the board has substantially the same size as the wall part.

In one embodiment of the invention the wall part is a splash board of tiles, glass, plastic, stone or metal.

In one embodiment of the invention it is a furniture assembly for a kitchen, a laundry room or a bathroom.

In one embodiment of the invention the upper module is configured to be mounted to a wall in the room in the mounting position and wherein the wall part is arranged to be provided in the same orientation as and adjacent to the same wall in the room as the upper module is configured to be mounted to.

In one embodiment of the invention the lower module is configured to be standing on a floor in the room in the mounting position and/or mounted to a wall in the room.

In one embodiment of the invention the upper module comprises one or more of cupboards, cabinets, shelves, oven, microwave and a fan and the lower module comprises one or more of a worktop, cupboards, cabinets, drawers, stove, range, sink, dishwasher, washing machine and tumble-drier.

In one embodiment of the invention the wall part is pre-mounted to the upper module. In another embodiment of the invention the wall part is pre-mounted to the lower module.

DETAILED DESCRIPTION OF EMBODIMENTS

Figure 1:
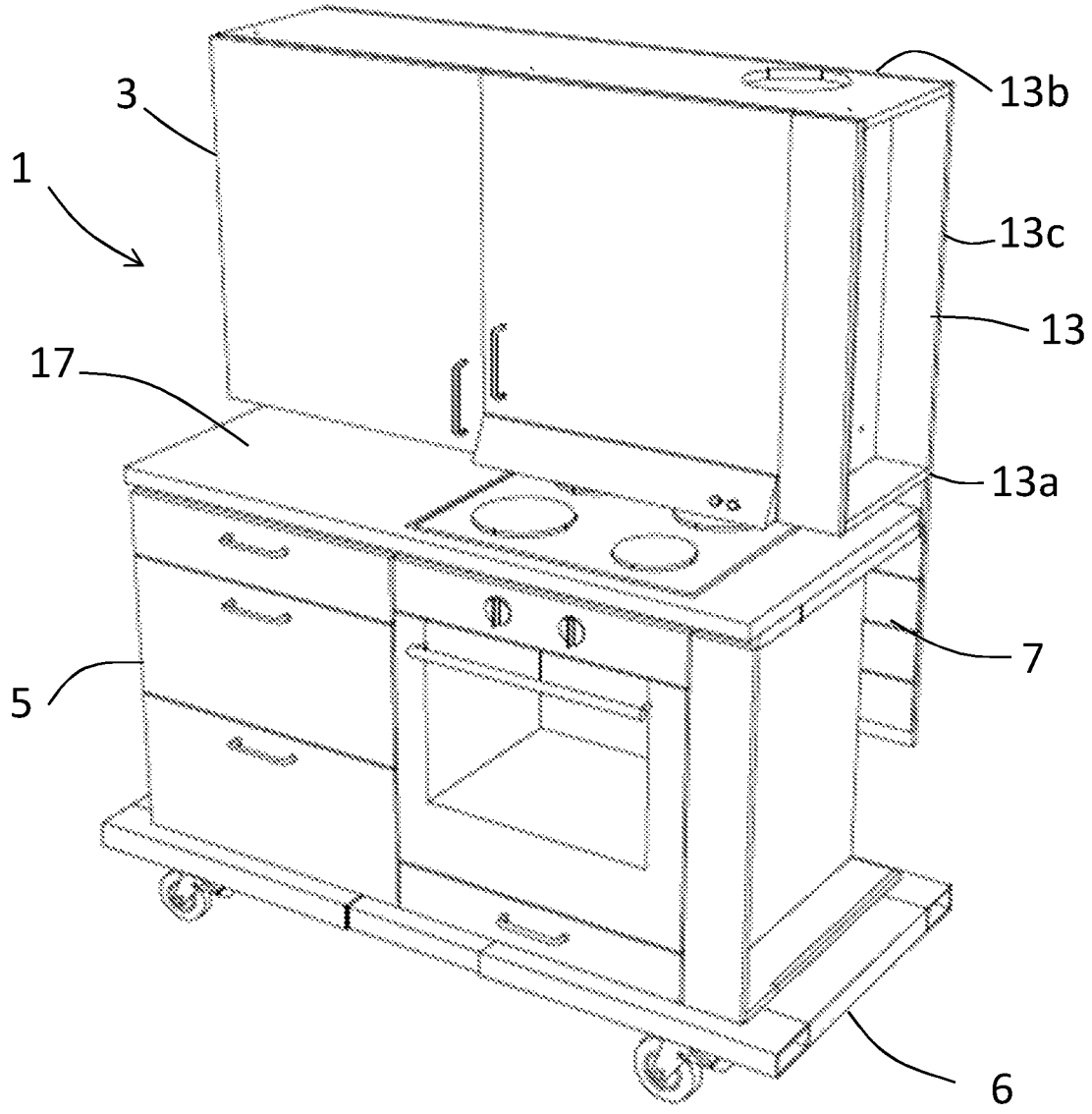
FIGS. 1-3 show a furniture assembly according to one embodiment of the invention in a delivery position.

According to the invention a furniture assembly 1; 101 is provided comprising an upper module 3; 103, a lower module 5; 105 and a wall part 7; 107 which is arranged for being provided between the upper and the lower module when the furniture assembly 1; 101 is mounted in a room in a mounting position with the upper module 3; 103 provided above the lower module 5; 105. The wall part 7; 107 is pre-mounted to either the upper module 3; 103 or the lower module 5; 105. One embodiment of the invention where the wall part 7 is pre-mounted to the upper module 3 is shown in FIGS. 1-5 and another embodiment of the invention where the wall part 107 is pre-mounted to the lower module 105 is shown in FIGS. 6-10. The embodiments will be further described in detail below with reference to the Figures.

The furniture assembly 1; 101 can be provided in a delivery position and in a mounting position, wherein a distance between the upper module 3; 103 and the lower module 5; 105 is smaller in the delivery position than in the mounting position and wherein the pre-mounted wall part 7; 107 in the delivery position is projecting overlapping a part of a backside 15; 113 of the one of the upper or lower module to which it is not pre-mounted. Hereby the furniture assembly can be provided in a more compact delivery position which is advantageous during delivery and transferring of the furniture assembly for example into a house and into the room where it should be mounted. For example through door openings and in lifts the space may be limited and the compact delivery position will be advantageous. The furniture assembly 1; 101 can be a kitchen, laundry or bathroom furniture assembly. The wall part 7; 107 can be a splash board of for example tiles, glass, plastic, stone or metal which can be easily wiped off and therefore suitable in for example a kitchen, a laundry or a bathroom. The upper module 3; 103 is configured for being mounted to a wall in a room, for example a kitchen, laundry or bathroom and the lower module 5; 105 is configured for being provided below the upper module standing on the floor in the room and/or mounted to wall.

The pre-mounted wall part 7; 107 can be provided to a projecting part 21;121 of a board 19; 119 which is covering the backside 13; 115 of the upper module 3 or the lower module 105. Said projecting part 21; 121 is projecting towards the one of the upper or the lower module to which the pre-mounted wall part 7; 107 is not pre-mounted.

The upper module 3; 103 can for example comprise one or more of cupboards, cabinets, shelves, oven, microwave and a fan and the lower module 5; 105 can for example comprise one or more of a worktop, cupboards, cabinets, drawers, stove, range, sink, dishwasher, washing machine and tumble-drier.

Two different embodiments according to the invention will now be described in more detail with reference to the drawings 1-10.

Figure 2:
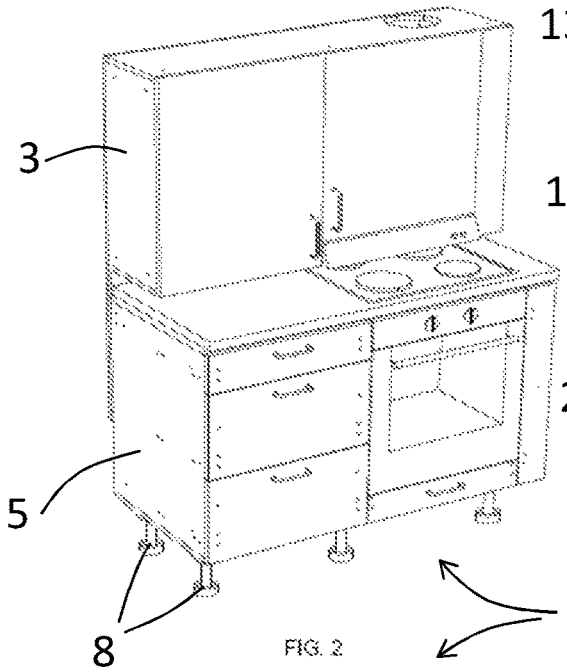
Figure 3:
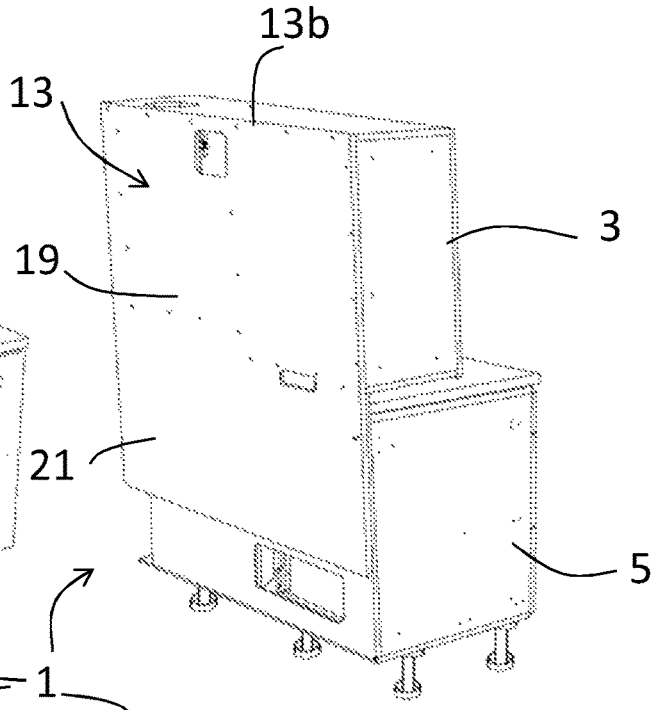
Figure 4:
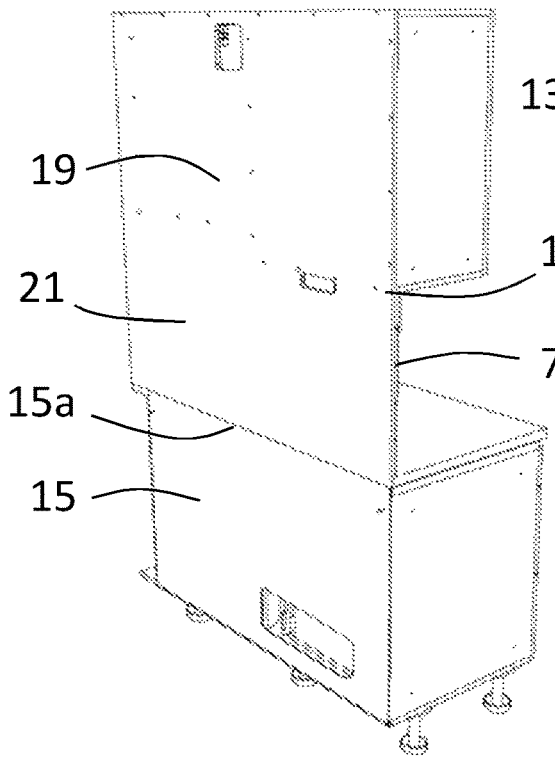
FIGS. 4-5 show the same furniture assembly as in FIGS. 1-3 but in a mounting position.
Figure 5:
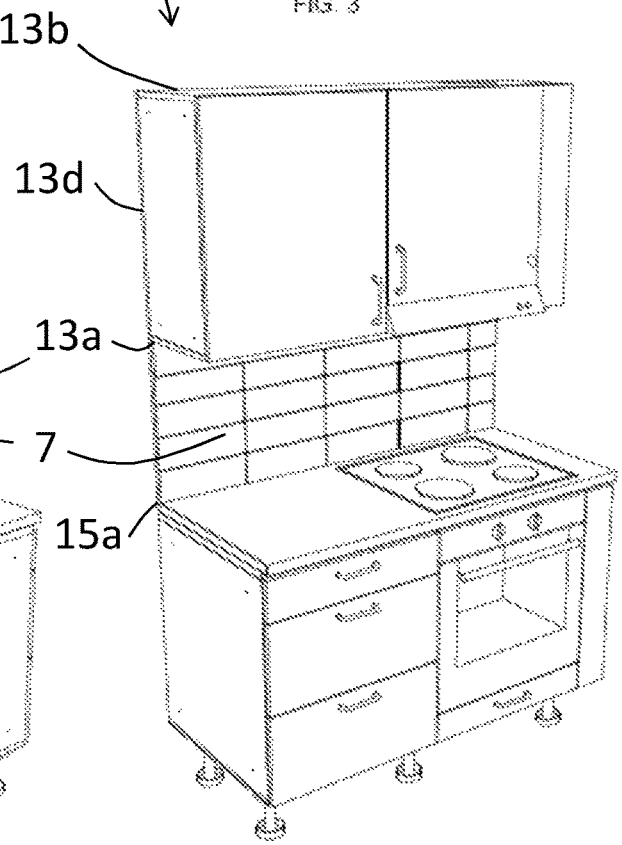

FIGS. 1-3 show a furniture assembly 1 according to one embodiment of the invention in a delivery position. FIGS. 4-5 show the same furniture assembly 1 as in FIGS. 1-3 but in a mounting position. The furniture assembly 1 comprises an upper module 3 and a lower module 5 where the upper module 3 is arranged to be provided above the lower module when mounted in a room. The furniture assembly 1 is here shown to be a kitchen furniture assembly where the lower module 5 comprises an oven and drawers and the upper module 3 comprises a fan and cabinets. The furniture assembly 1 is in this delivery position provided onto a wagon 6. Hereby the furniture assembly can be easily moved into a position where it should be mounted. When the furniture assembly 1 has been moved into the right position for mounting the wagon 6 can be removed and legs 8 can be provided to the lower module 5 such that the lower module 5 can be standing onto the floor as shown in FIG. 2. However the legs 8 are not necessary. The lower module 5 can instead be mounted to the wall or be standing directly on the floor.

According to this embodiment of the invention a wall part 7 is provided pre-mounted to the upper module 3. The wall part 7 is projecting from a backside 13 of the upper module 3. Referring to directions in the drawings the wall part 7 is projecting downwards from the backside 13 of the upper module 3. The wall part 7 is hereby projecting from a lower side 13*a* of the backside 13 of the upper module 3. In this embodiment a backside 13 of the upper module 3 is rectangular comprising a lower side 13*a*, an opposing upper side 13*b* and two short sides 13*c*, 13*d*. The geometry of the upper module 3 does however not necessarily be rectangular. The upper module 3 is configured to be mounted to a wall in the room in the mounting position such that the backside 13 of the upper module 3 is provided against the wall. The wall part 7, which is projecting downwardly from a lower side 13*a* of the backside 13 of the upper module 3 is arranged to be provided in the same orientation as and adjacent to the same wall in the room as the upper module 3 is configured to be mounted to. The lower module 5 is configured to be standing on a floor in the room in the mounting position or mounted to a wall in the room. The mounting position is shown in FIGS. 4 and 5.

In the delivery position as shown in FIGS. 1-3 the upper module 3 is provided close to the lower module 5 with the wall part 7 projecting over a part of a backside 15 of the lower module 5. The upper module 3 can be provided leaning on a top surface 17 of the lower module 5. However in FIGS. 1-3 a small distance between the upper module 3 and the lower module 5 is shown to be provided in the delivery position. A support can hereby be provided between the upper module 3 and the lower module 5 such that the upper module 3 is not leaning directly onto the upper surface 17 of the lower module 5.

When the furniture assembly 1 has been transferred into a position in a room where it should be mounted the upper module 3 is raised in relation to the lower module 5 and the upper module 3 is mounted to a wall in the room, for example in a kitchen, laundry or bathroom. The upper module 3 is raised a distance above the lower module 5 such that the wall part 7 which is pre-mounted to the upper module 3 will adjoin an upper side 15*a* of a backside 15 of the lower module 5 with the lower side 13*a* of the backside 13 of the upper module 3. In other words the wall part 7 is in the mounting position reaching between the lower side 13*a* of the backside 13 of the upper module 3 and the upper side 15*a* of the backside 15 of the lower module 5. The wall part 7 is hereby provided in the same orientation as and against the same wall as the upper module 3 is mounted to.

In this embodiment of the invention as shown in FIGS. 1-5 the wall part 7 is provided onto a projecting part 21 of a board 19 which is mounted to the backside 13 of the upper module 3. The board 19 is mounted to the backside 13 such that the projecting part 21 of the board 19 projects from the lower side 13*a* of the backside 13 of the upper 3 module. The projecting part 21 of the board 19 has substantially the same size as the wall part 7. The board 19 can suitably be the back itself of the upper module 3, which back is covering the backside 13 of the upper module 3 and which back is made larger than the backside of the upper module for projecting downwards towards the lower module 5.

Figure 6:
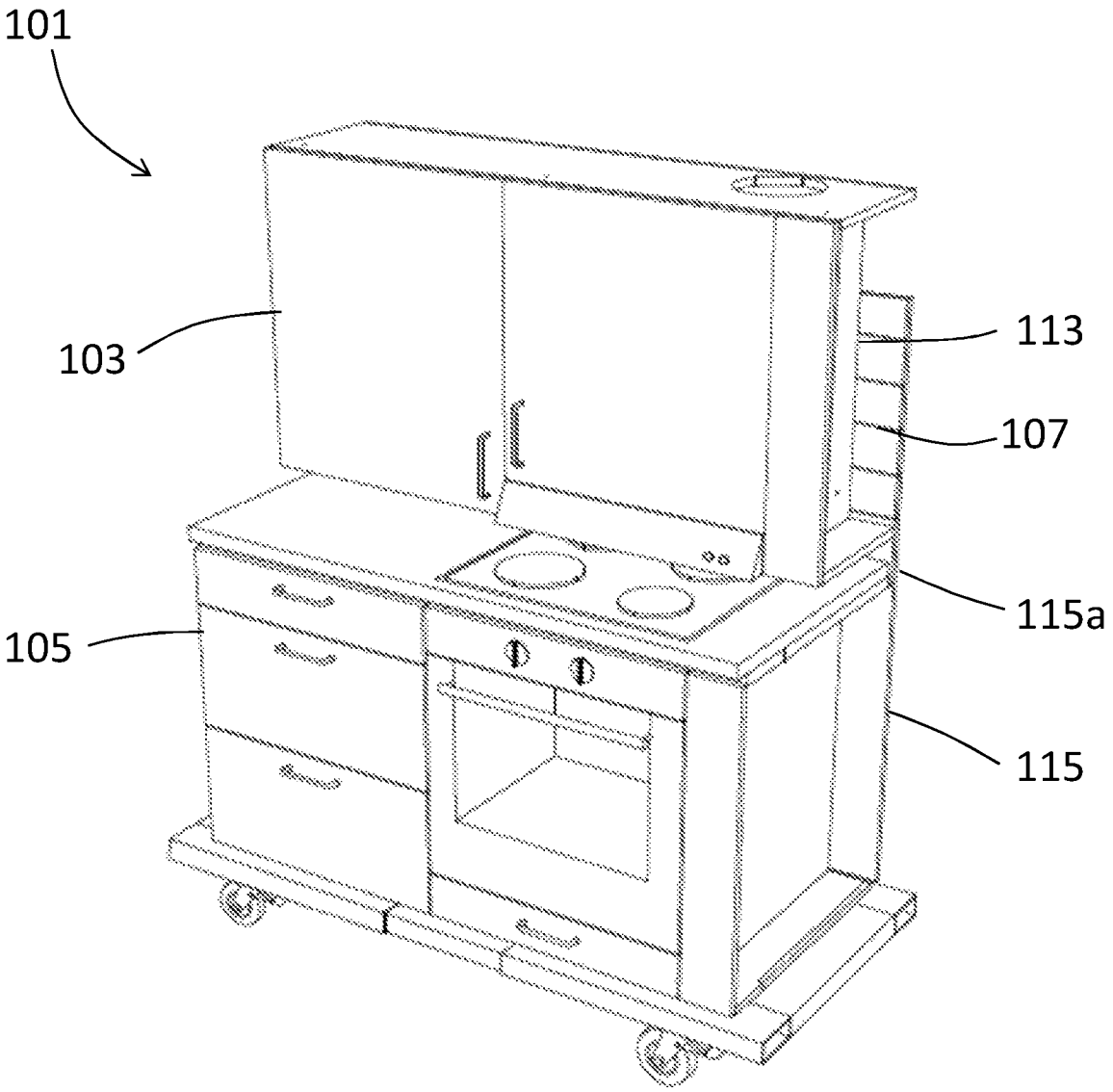
FIGS. 6-8 show a furniture assembly according to another embodiment of the invention in a delivery position.
Figure 7:
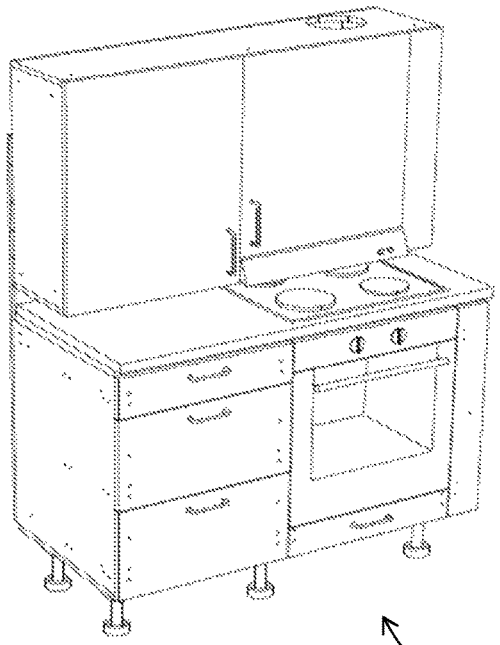
Figure 8:
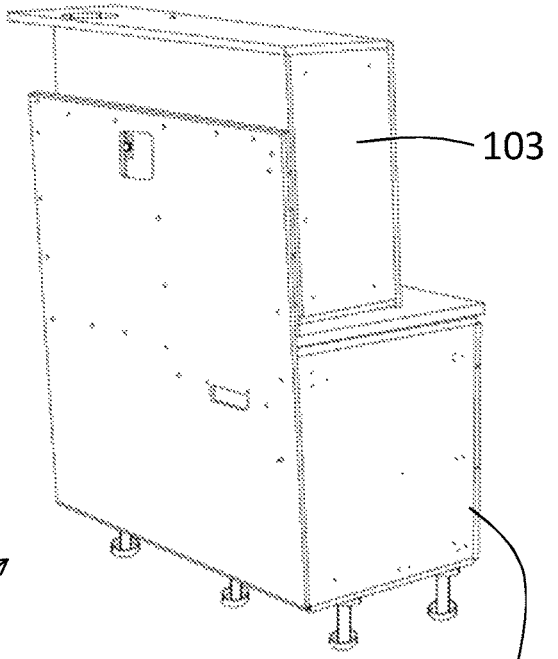
Figure 9:
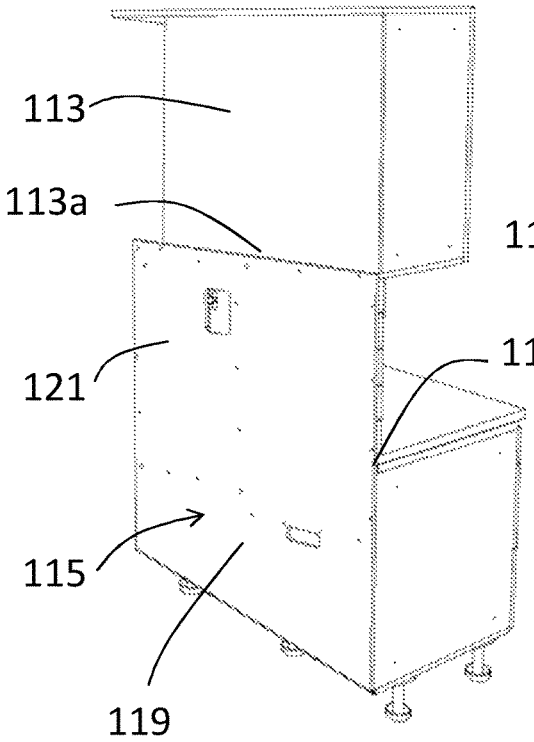
FIGS. 9-10 show the same furniture assembly as in FIGS. 6-8 but in a mounting position.
Figure 10:
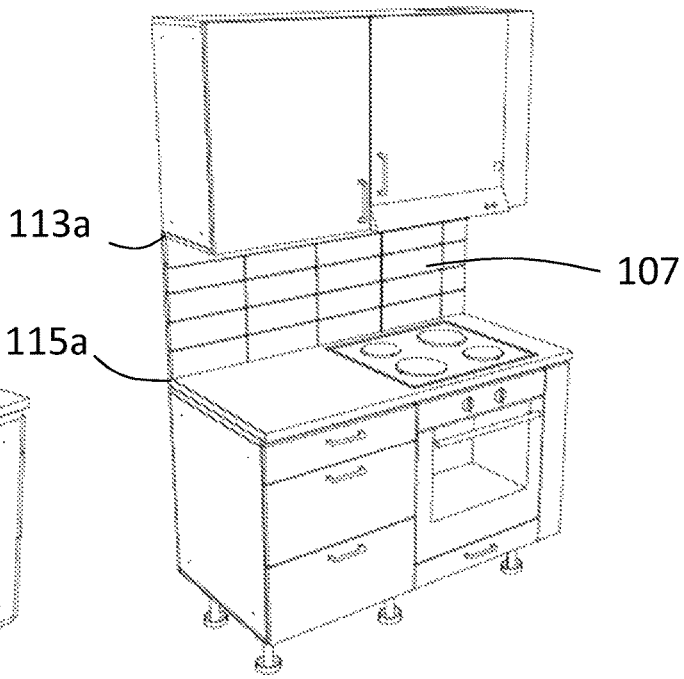

Another embodiment of a furniture assembly 101 according to the invention where the wall part 107 is pre-mounted to the lower module 105 is shown in FIGS. 6-10. In FIG. 6-8 the furniture assembly 101 is provided in a delivery position with an upper module 103 provided close to a lower module 105 and in FIGS. 9-10 the furniture assembly 101 is provided in a mounting position where the upper module 103 has been raised in relation to the lower module 105. Many of the details are the same as in the previous embodiment and will not be described in detail again. The difference in this embodiment is that a wall part 107 is pre-mounted to the lower module 105 instead of to the upper module 103. The wall part 107 is projecting from an upper side 115*a* of a backside 115 of the lower module 105. Hereby the wall part 107 is in the delivery position projecting over a part of a backside 113 of the upper module 103 and the wall part 107 will in the mounting position be reaching between a lower side 113*a* of the backside 113 of the upper module and an upper side 115*a* of a backside 115 of the lower module 105. Also in this embodiment the wall part 107 is provided onto a projecting part 121 of a board 119 which board 119 is provided to the backside 115 of the lower module 105. The board can suitably be the back itself which is covering the backside 115 of the lower module 5, which back is made larger than the backside of the lower module for projecting upwards towards the upper module.

Figure 11:
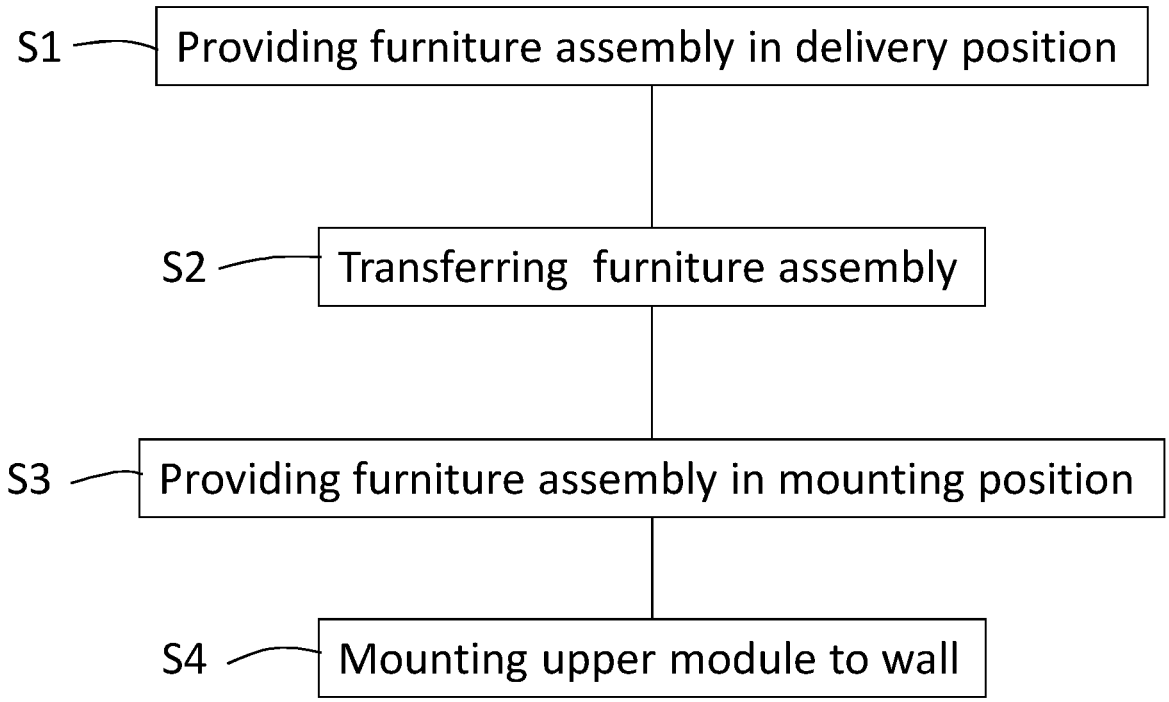
FIG. 11 is a flow chart of a method according to one embodiment of the invention.

FIG. 11 is a flow chart of a method for delivering and mounting a furniture assembly 1; 101 as described above in a room according to one embodiment of the invention. The method comprises the steps:

S1: Providing the furniture assembly 1; 101 in a delivery position, wherein a distance between the upper module 3; 103 and the lower module 5; 105 is smaller in the delivery position than in a mounting position and wherein the pre-mounted wall part 7; 107 in the delivery position is projecting overlapping a part of a backside 15; 113 of the one of the upper module 103 or lower module 5 to which it is not pre-mounted.

S2: Transferring the furniture assembly 1; 101 in its delivery position to a place in a room where it should be mounted.

S3: Providing the furniture assembly 1; 101 in a mounting position by raising the upper module 3; 103 in relation to the lower module 5; 105 such that the wall part 7; 107 is adjoining a backside 13; 113 of the upper module 3; 103 with a backside 15; 115 of the lower module 5; 105.

S4: Mounting the upper module 3; 103 to a wall in the room where it should be mounted.

The invention claimed is:

1. A furniture assembly (1; 101) for a kitchen, a laundry room or a bathroom, comprising:

an upper module (3; 103);

a lower module (5; 105); and a wall part (7; 107) which is arranged to extend between a lower surface of the upper module and an upper surface of the lower module when the furniture assembly (1; 101) is mounted in a room in a mounting position with the upper module (3; 103) provided above the lower module (5; 105), wherein said wall part (7; 107) is pre-mounted to either the upper module (3) or the lower module (105)

and not mounted to the other upper or lower module (5; 103) such that the wall part (7; 107) is laterally slidable in relation to the upper or lower module (5; 103) to which the wall part (7; 107) is not pre-mounted and into a delivery position where the upper and lower modules (3, 5; 103, 105) are closer to each other and the wall part (7; 107) covers a part of a backside (15; 113) of the upper or lower module (5; 103) to which the wall part (7; 107) is not pre-mounted, and into a mounting position in which the wall part (7; 107) connects the lower surface of the backside (13; 113) of the upper module (3; 103) with the upper surface of the backside (15; 115) of the lower module (5; 105), the wall part (7; 107) has a wipeable surface, a board (19; 119) is mounted to the backside (13; 115) of the upper module (3) or the lower module (105) and comprises a projecting part (21; 121) on which the wall part (7;107) is mounted, said board (19; 119) is mounted with the projecting part (21; 121) of the board (19; 119) projecting upwardly or downwardly from the backside (13; 115) of the upper (3) or lower (105) module to which the board (19;119) is mounted, and the projecting part (21; 121) of the board (19;119) has substantially the same dimensions as the wall part (7; 107).

2. A furniture assembly according to claim 1, wherein said furniture assembly (1; 101) is configured to be provided in a delivery position and in a mounting position, a distance between the upper module (3; 103) and the lower module (5; 105) is smaller in the delivery position than in the mounting position, and the pre-mounted wall part (7; 107) in the delivery position projectingly overlaps a part of the backside (15; 113) of the upper or lower module to which it is not pre-mounted.

3. A furniture assembly according to claim 1, wherein the wall part (7; 107) extends between a lower side (13*a*) of the backside (13; 113) of the upper module (3; 103) and an upper side (15*a*) of the backside (15; 115) of the lower module (5; 105) when the furniture assembly (1; 101) is in the mounting position.

4. A furniture assembly according to claim 1, wherein the wall part (7; 107) is a splash board of tiles, glass, plastic, stone or metal.

5. A furniture assembly according to claim 1, wherein the upper module (3; 103) is configured to be mounted to a wall in the room in the mounting position, and the wall part (7; 107) is arranged to be provided in the same orientation as and adjacent to the same wall in the room as the upper module (3; 103) is configured to be mounted to.

6. A furniture assembly according to claim 1, wherein the lower module (5; 105) is configured to be standing on a floor in the room in the mounting position and/or mounted to a wall in the room.

7. A furniture assembly according to claim 1, wherein the upper module (3; 103) comprises one or more of cupboards, cabinets, shelves, an oven, a microwave and a fan and the lower module (5; 105) comprises one or more of a worktop, cupboards, cabinets, drawers, a stove, a range, a sink, a dishwasher, a washing machine and a tumble-drier.

8. A furniture assembly according to claim 1, wherein the wall part (7) is pre-mounted to the upper module (3).

9. A furniture assembly according to claim 1, wherein the wall part (107) is pre-mounted to the lower module (105).

10. A method for delivering and mounting a furniture assembly (1; 101) according to claim 1 in a room, said method comprising the steps of:

providing (S1) the furniture assembly (1; 101) in a delivery position, wherein a distance between the upper module (3; 103) and the lower module (5; 105) is smaller in the delivery position than in a mounting position and the pre-mounted wall part (7; 107) in the delivery position projectingly overlaps a part of the backside (15; 113) of the one of the upper module (103) or lower module (5) to which it is not pre-mounted;

transferring (S2) the furniture assembly (1; 101) in its delivery position to a place in a room to be mounted; and providing (S3) the furniture assembly (1; 101) in a mounting position by raising the upper module (3; 103) in relation to the lower module (5; 105) such that the wall part (7; 107) is adjoining the backside (13; 113) of the upper module (3; 103) with the backside (15; 115) of the lower module (5; 105).

11. A method according to claim 10, further comprising the step of mounting (S4) the upper module (3; 103) to a wall in the room where it should be mounted.

12. A furniture assembly according to claim 1, wherein the wall part (7; 107) is a splash board of tiles, glass, plastic, stone or metal, and the upper module (3; 103) comprises one or more of cupboards, cabinets, shelves, an oven, a microwave and a fan and the lower module (5; 105) comprises one or more of a worktop, cupboards, cabinets, drawers, a stove, a range, a sink, a dishwasher, a washing machine and a tumble-drier.

* * * * *